US012127629B2

(12) United States Patent
Lebo

(10) Patent No.: US 12,127,629 B2
(45) Date of Patent: Oct. 29, 2024

(54) VAMP CONSTRUCTION AND METHOD OF CONSTRUCTING THE SAME

(71) Applicant: Jonathan K. Lebo, Lebanon, PA (US)

(72) Inventor: Jonathan K. Lebo, Lebanon, PA (US)

(73) Assignee: Columbia Insurance Company, Omaha, NE (US)

( * ) Notice: Subject to any disclaimer, the term of this patent is extended or adjusted under 35 U.S.C. 154(b) by 999 days.

(21) Appl. No.: 15/299,963

(22) Filed: Oct. 21, 2016

(65) Prior Publication Data

US 2018/0110293 A1 Apr. 26, 2018

(51) Int. Cl.
*A43B 23/02* (2006.01)
*A43B 7/12* (2006.01)

(52) U.S. Cl.
CPC ..... *A43B 23/026* (2013.01); *A43B 7/125* (2013.01); *A43B 23/021* (2013.01); *A43B 23/022* (2013.01); *A43B 23/027* (2013.01); *A43B 23/0275* (2013.01)

(58) Field of Classification Search
CPC . A43B 23/026; A43B 23/022; A43B 23/0275; A43B 23/027; A43B 23/021; A43B 23/0295; A43B 7/025; A43B 23/0235; A43B 23/025
USPC ..... 36/3 A, 47, 48
See application file for complete search history.

(56) References Cited

U.S. PATENT DOCUMENTS 1,949,159 A * 2/1934 Glidden ..... A41B 17/00 442/306
2,240,626 A * 5/1941 Ochs ..... A43B 1/0072 36/3 A
2,350,879 A * 6/1944 Daniels ..... A43B 23/16 36/45
2,818,663 A * 1/1958 Copeland ..... A43B 23/0295 36/45
3,114,213 A * 12/1963 Bowers ..... A43B 23/025 36/48
4,149,323 A * 4/1979 Roy ..... A43B 23/0295 36/48
5,337,493 A * 8/1994 Hill ..... A43B 23/26 36/114
5,345,638 A * 9/1994 Nishida ..... A41H 3/08 12/146 C
5,566,475 A * 10/1996 Donnadieu ..... A43B 5/00 36/55
5,644,813 A * 7/1997 Puskas ..... A43B 3/16 15/227
6,237,251 B1 * 5/2001 Litchfield ..... A43B 1/0072 36/114
7,347,011 B2 * 3/2008 Dua ..... A43B 1/04 36/45
8,544,191 B2 * 10/2013 Marvin ..... A43B 9/12 36/45
2001/0032399 A1 * 10/2001 Litchfield ..... A43B 1/0072 36/88

(Continued)

*Primary Examiner* — Megan E Lynch
(74) *Attorney, Agent, or Firm* — IP Attorneys Group, LLC

(57) ABSTRACT

Disclosed are a vamp construction and a method of vamp construction utilizing multiple layers in a multi-part vamp. This construction provides increased flexibility and comfort, more efficient material utilization, and aesthetic appeal. More specifically, the vamp includes a layer of vamp material, a layer of fabric, and a layer of elastic material.

9 Claims, 9 Drawing Sheets

(56) References Cited

U.S. PATENT DOCUMENTS

2004/0058102 A1* 3/2004 Baychar ..... A43B 5/0405 428/34.1
2004/0200095 A1* 10/2004 McAlpine ..... A43B 3/02 36/83
2005/0193592 A1* 9/2005 Dua ..... A43B 1/04 36/45
2005/0210708 A1* 9/2005 Chen ..... A43B 7/125 36/55
2006/0112594 A1* 6/2006 Kilgore ..... A43B 23/042 36/45
2007/0245595 A1* 10/2007 Chen ..... A43B 7/08 36/45
2008/0086913 A1* 4/2008 Nawachi ..... A43B 3/10 36/94
2010/0024254 A1* 2/2010 Combs ..... A43B 7/125 36/3 A
2011/0107621 A1* 5/2011 Mordecai ..... A43B 3/02 36/113
2011/0265347 A1* 11/2011 Leary ..... A43B 7/1465 36/93
2011/0277349 A1* 11/2011 Kim ..... A43B 7/1405 36/84
2012/0233884 A1* 9/2012 Greene ..... A43B 23/02 36/84
2013/0251955 A1* 9/2013 Lee ..... A43B 3/0078 428/172
2013/0269209 A1* 10/2013 Lang ..... A43B 23/0235 36/45
2014/0059886 A1* 3/2014 Lyttle ..... A43B 1/00 36/55
2014/0115923 A1* 5/2014 Meythaler ..... A43B 23/0225 36/47
2014/0202041 A1* 7/2014 Kupferberg ..... A43B 3/0078 36/136
2014/0259760 A1* 9/2014 Dojan ..... A43B 23/0275 36/45
2014/0283410 A1* 9/2014 Marvin ..... B29D 35/148 36/45
2014/0345165 A1* 11/2014 Norwood ..... A43B 9/06 36/109
2014/0352173 A1* 12/2014 Bell ..... D04B 21/207 36/50.1
2014/0352178 A1* 12/2014 Bruce ..... A43B 17/08 36/3 A
2014/0352179 A1* 12/2014 Bell ..... A43B 3/0031 36/9 R
2015/0223567 A1* 8/2015 Lee ..... B44C 3/02 36/45
2015/0289592 A1* 10/2015 Song ..... A43B 1/0072 36/83
2016/0213096 A1* 7/2016 Borel ..... A43B 7/085

* cited by examiner

VAMP CONSTRUCTION AND METHOD OF CONSTRUCTING THE SAME

FIELD OF THE INVENTION

This invention relates to a vamp construction, and more particularly pertains to a multipart vamp.

DESCRIPTION OF THE BACKGROUND ART

A variety of different shoe constructions are sometimes used in the modern footwear industry, with each construction being commonly suited for a specific application. Some constructions may be suited for everyday use and may be designed primarily for the comfort of the wearer's foot. Other constructions may be more formal and may employ elaborate and aesthetically appealing designs. Still yet other constructions may be tailored for working environments and may be designed for increased durability and foot protection. Although each of the above referenced constructions share similar components, they also each typically employ features unique to its intended purpose.

The art is replete with attempts of making waterproof, breathable footwear that is also comfortable for the wearer. Early attempts for making such footwear may include upper materials such as leather treated to make it water resistant and soles made of rubber. Thus, some breathability was achieved. However, several problems arose with this type of footwear construction. If the upper material was to be made truly waterproof, it may lose its ability to breathe and be tight fitting on the wearer's foot. Moreover, the connecting region between the waterproof sole and the upper can be a major source of leakage as there was no effective way to make the connecting region waterproof.

An alternative approach to the goal of achieving comfortable waterproof footwear sometimes involved employing a waterproof insert or bootie into the shoe. This waterproof insert, if constructed of appropriate materials, commonly had the additional advantage of being permeable to water vapor so that there was a possibility of no buildup of water vapor within the shoe over the time when the shoe was being worn.

Further approaches may include securing, by a lasting process, a waterproof, breathable liner material to the inside of the footwear upper and sealing the liner material to a waterproof gasket or insole. There have possibly been many different attempts at providing a durable, waterproof seal or connection at the region where the liner material is joined with the waterproof gasket or insole.

One problem that often results when forming such waterproof, breathable footwear is that the insertion of the liner or bootie will sometimes result in a poor fitting shoe (i.e., a smaller fit due to the liner being inserted into the already sized shoe upper) and/or poor attachment between the liner or bootie and the shoe upper material, which can result in, among other things, perhaps a less than desirable appearance of the inside of the footwear (i.e., the liner appears wrinkled or pulls away from the upper).

An additional problem is that occasionally because of the multiple extra layers typically needed for manufacturing an article of waterproof footwear, flexibility may be severely compromised. In other words, the typical prior art waterproof shoe can be much less flexible than prior art non-waterproof footwear.

Thus, the search continues for waterproof breathable footwear that is both durably sealed, flexible, and comfortable, yet economical to manufacture.

SUMMARY OF THE INVENTION

It is therefore an object of this invention to provide a method of constructing a vamp for footwear. In some embodiments, the method comprises the steps of providing a vamp material, providing a fabric, providing an elastic material, securing the vamp material to the fabric, and securing the elastic material to the fabric. In other embodiments, the method further comprises a step of securing at least a second fabric to the vamp material. In yet other embodiments, the method further comprises a step of securing at least a second elastic material to the fabric. In yet other embodiments, the method further comprises a step of laminating the vamp material to the fabric. In yet other embodiments, the method further comprises a step of stitching the elastic material to the fabric. In yet other embodiments, the method further comprises steps of securing the fabric to a second fabric, securing the second fabric to the elastic material, and securing the elastic material to a second elastic material.

It is a further object of this invention to provide an article of footwear comprising a vamp. In some embodiments, the vamp comprises at least a layer of vamp material, at least a first layer of fabric, and at least a first layer of elastic material, wherein the first layer of fabric is securing in between the layer of vamp material and the first layer of elastic material. In other embodiments, the vamp further comprises at least a second layer of fabric secured in between the layer of vamp material and the first layer of elastic material. In yet other embodiments, the vamp further comprises a layer of vamp material secured in between the first layer of fabric and the first layer of elastic material. In yet other embodiments, the vamp further comprises a waterproof fabric. In yet other embodiments, the vamp further comprises at least a second layer of fabric and at least a second layer of elastic material, both of which are secured to the layer of vamp material in an alternating manner. In yet other embodiments, the vamp further comprises a vamp material that is the outer layer. In yet other embodiments, the vamp further comprises a first layer of elastic material that is the inner layer.

It is a further object of this invention to provide a method of constructing a vamp for footwear. In some embodiments, the method comprises the steps of providing first vamp material, providing a second vamp material that is larger than the first vamp material, providing a fabric, providing an elastic material, securing the first and second vamp materials to each other, securing the first vamp material to the fabric, and securing the elastic material to the fabric in order to form a multi-layer vamp. In other embodiments, the method further comprises a step of providing an opening in the fabric. In yet other embodiments, the method further comprises a step of providing a third vamp material that is smaller than the first vamp material. In yet other embodiments, the method further comprises a step of providing an opening in any of the vamp materials. In yet other embodiments, the method further comprises a step of providing an opening in the elastic material. In yet other embodiments, the method further comprises a step of forming a saddle portion.

The foregoing has outlined rather broadly the more pertinent and important features of the present invention in order that the detailed description of the invention that follows may be better understood so that the present invention is more fully appreciated. Additional features of the invention will be described hereinafter which form the subject of the claims of the invention. It should be appreciated that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
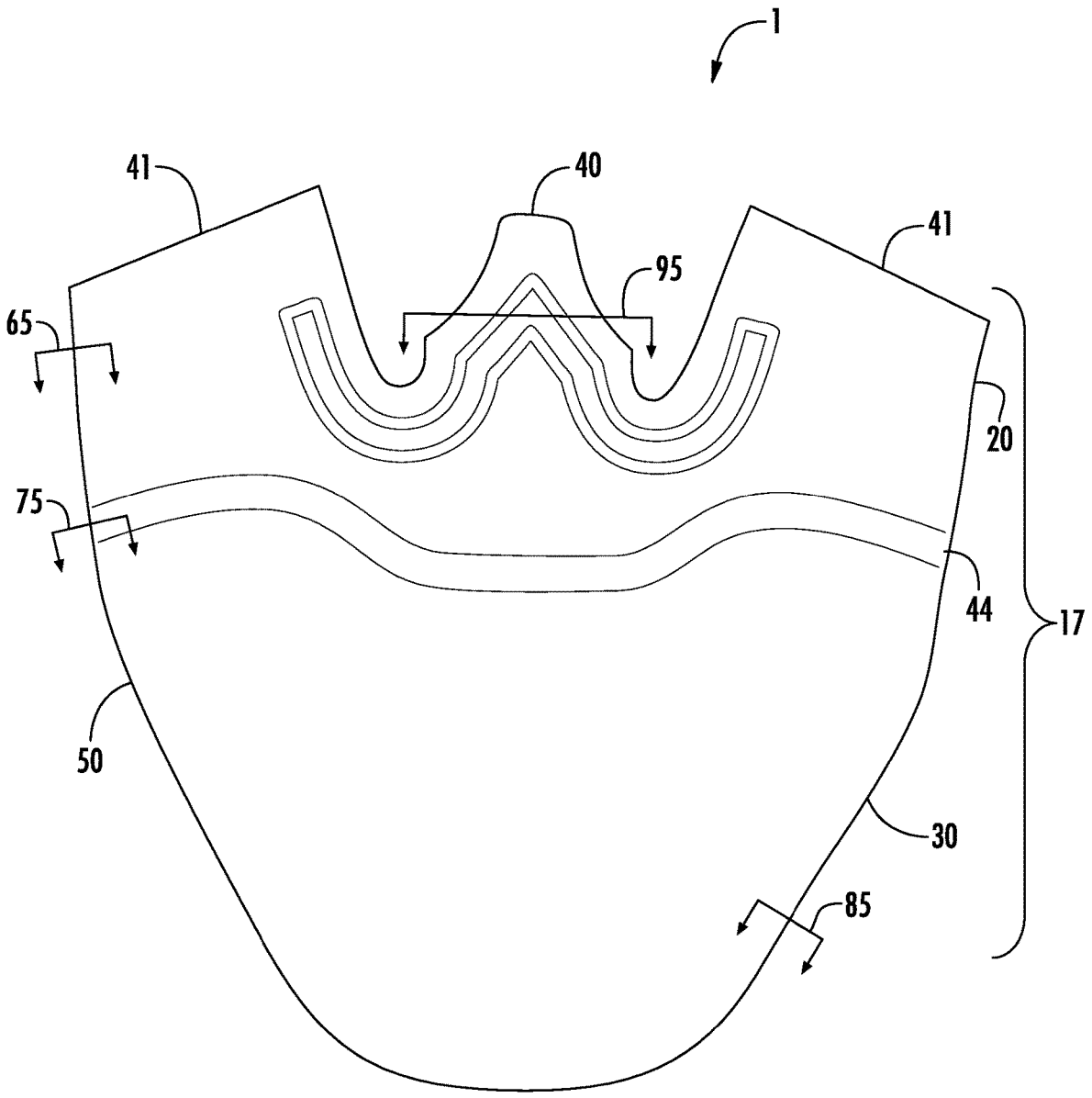
FIG. 1 is a top view of a vamp construction.
Figure 15:
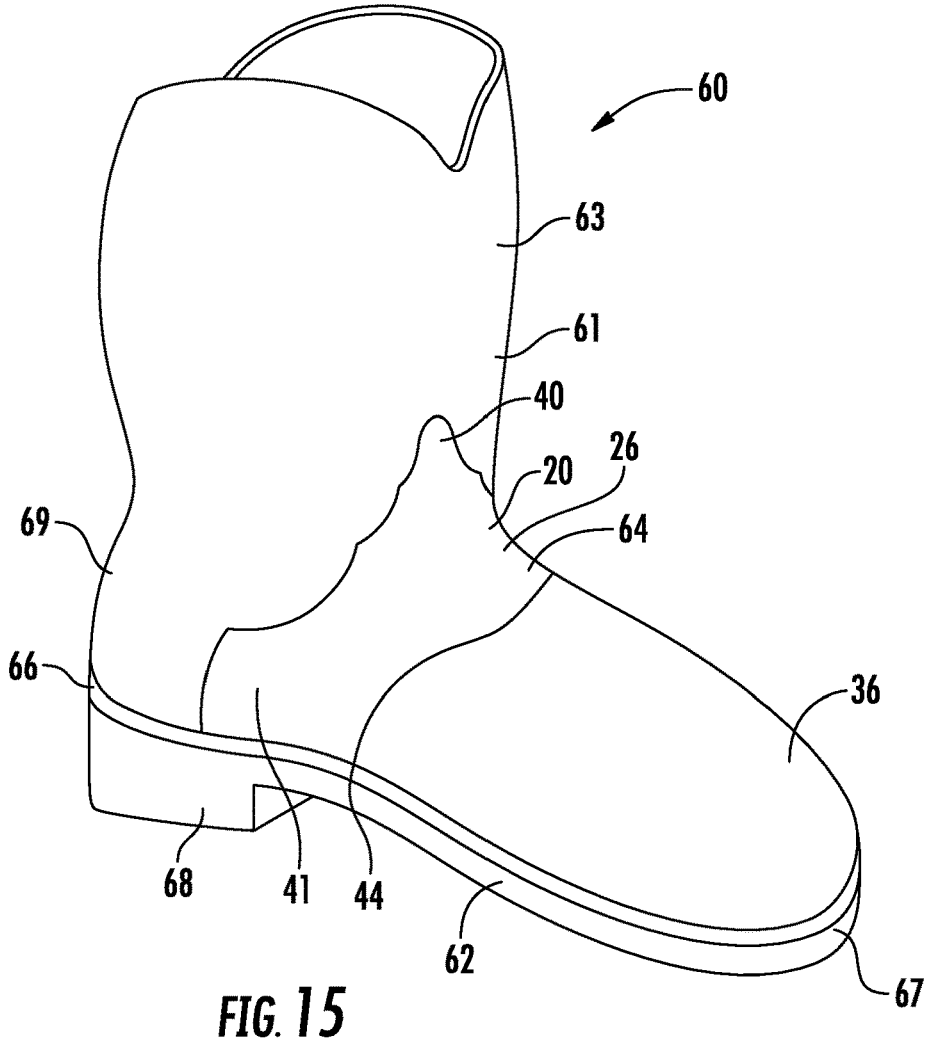
FIG. 15 is a prospective view of an article of footwear with the vamp depicted in FIG. 1

The present invention relates to a vamp construction and a method of constructing a vamp for footwear. This vamp construction and method provide greater comfort and flexibility at a reduced cost. More specifically, the vamp construction includes a forward portion (36) and a rearward portion (26). In some embodiments as depicted in FIG. 15, the forward portion (36) is a toe portion, and the rearward portion (26) is a saddle portion. In some embodiments, as depicted in FIG. 1, the forward (36) and rearward (26) portions are constructed entirely from leather. In other embodiments, as depicted in FIG. 1, the forward (36) and rearward (26) portions are constructed primarily of leather. In other embodiments, as depicted in FIG. 1, the forward (36) and rearward (26) portions are constructed of different materials, respectively. In other embodiments, as depicted in FIG. 1, the forward (36) and rearward (26) portions are constructed entirely from fabric. In other embodiments, as depicted in FIG. 1, the forward (36) and rearward (26) portions are constructed primarily from fabric. In other embodiments, as depicted in FIG. 1, the forward (36) and rearward (26) portions are constructed entirely from an elastic material. In other embodiments, as depicted in FIG. 1, the forward (36) and rearward (26) portions are constructed primarily of an elastic material. In other embodiments, as depicted in FIG. 1, the forward (36) and rearward (26) portions are constructed from any combination of leather, fabric, and elastic material. In one embodiment, the leather is water proof. In another embodiment, the leather is not waterproof. In one embodiment, the leather is water resistant. In another embodiment, the leather is not water resistant. In one embodiment, the fabric is waterproof. In another embodiment, the fabric is not waterproof. In one embodiment, the fabric is water resistant. In another embodiment, the fabric is not water resistant. In one embodiment, the elastic material is waterproof. In another embodiment, the elastic material is not waterproof. In one embodiment, the elastic material is water resistant. In another embodiment, the elastic material is not water resistant.

Figure 14A:
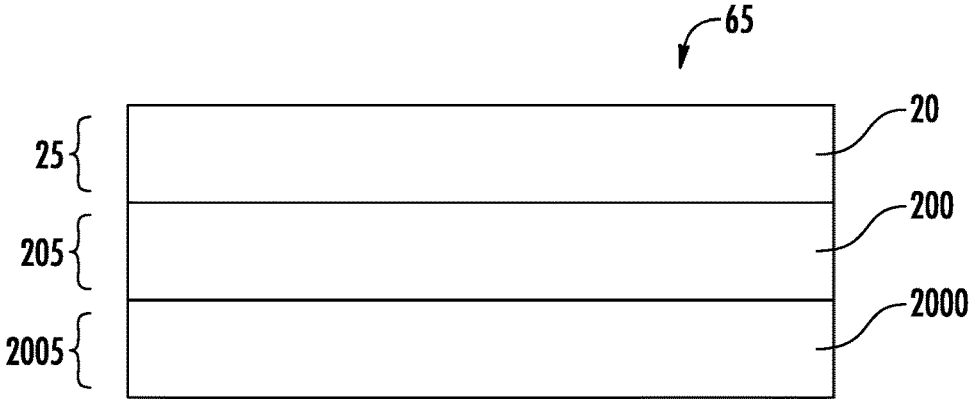
FIG. 14A is a cross-sectional view of the vamp depicted in FIG. 1.
Figure 14B:
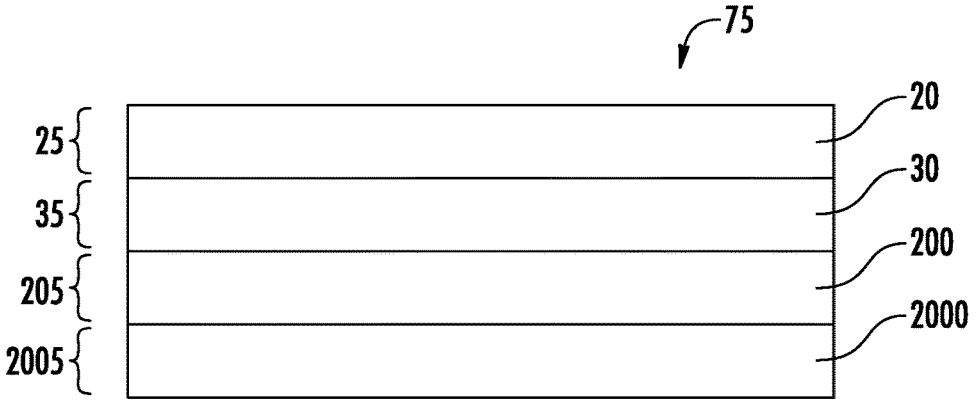
FIG. 14B is another cross-sectional view of the vamp depicted in FIG. 1.
Figure 14C:
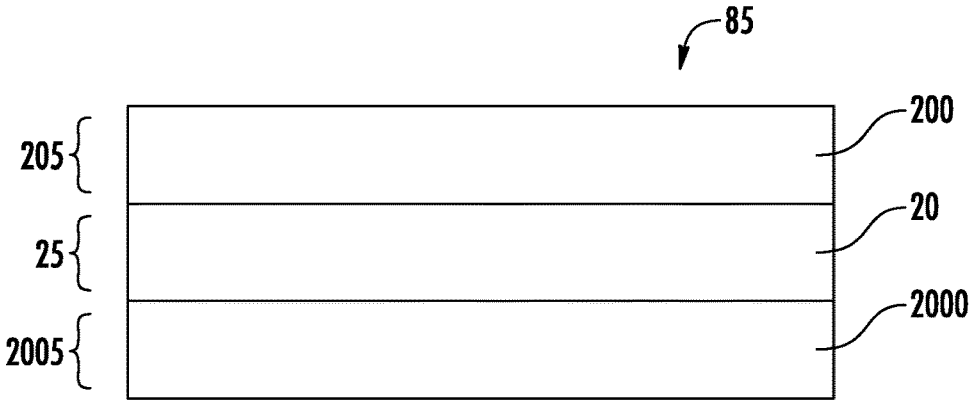
FIG. 14C is another cross-sectional view of the vamp depicted in FIG. 1.
Figure 14D:
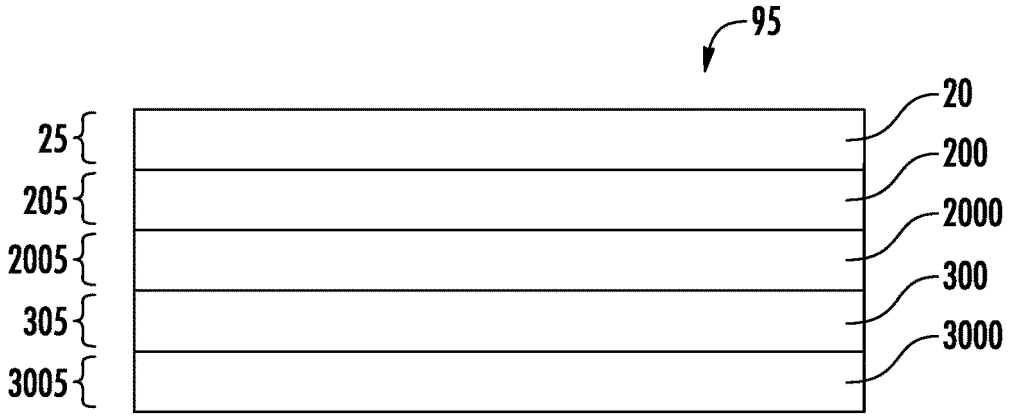
FIG. 14D is another cross-sectional view of the vamp depicted in FIG. 1.

In one embodiment as shown in FIGS. 14A-14D, the vamp construction (1) is comprised of multiple layers. In some embodiments, as shown in FIGS. 1 and 14A-14D, vamp material (20) is the outermost layer. In other embodiments, as shown in FIG. 14C, vamp material (20) is a middle layer. In another embodiment, vamp material (10)(20)(30) is the innermost layer. In some embodiments, as shown in FIG. 14C, fabric (200) is the outermost layer. In other embodiments, as shown in FIGS. 1 and 14D, fabric (200)(300) are middle layers. In other embodiments, fabric (100)(200)(300) is the innermost layer. In some embodiments, as shown in FIGS. 1 and 14A-14D, elastic material (2000) is the innermost layer. In other embodiments, as shown in FIG. 14D, elastic material (2000) is a middle layer. In yet other embodiments, elastic material (1000)(2000)(3000) is the outermost layer.

In some embodiments as shown in FIGS. 14A-14D, vamp material (10)(20)(30) includes a cross-sectional width (15)(25)(35) of any dimension. In one embodiment, the cross-sectional width (15)(25)(35) of the vamp material (10)(20)(30) is between approximately 1.0 and approximately 3.0 mm. In another embodiment, the cross-sectional width (15)(25)(35) of the vamp material (10)(20)(30) is between approximately 1.5 and approximately 2.5 mm. In another embodiment, the cross-sectional width (15)(25)(35) of the vamp material (10)(20)(30) is between approximately 1.8 and approximately 2.0 mm. Vamp materials (10)(20)(30) are responsible for providing support to and protection of the wearer's foot as well as providing support and structure to the overall article of footwear. It is therefore a requirement that vamp materials (10)(20)(30) exhibit a degree of hardness and a degree of flexibility. Hardness is defined as a textile's or a material's resistance to permanent indentation and in the context of the invention refers to a textile's or material's rating on the Shore Durometer Scale. There are several scales of Shore Durometer used for materials with different properties. The two most common scales, using slightly different measurement systems, are type A and type D scales. The A scale is for softer plastics, while the D scale is for harder ones. Generally, the lower the Shore Durometer rating, the softer a textile or material is. Various foams typical in the art have a rating of approximately 55 on the Shore Durometer Scale A. Rubber typically has a rating of approximately 25 on the Shore Durometer Scale A. Leather typically has a rating of approximately 80 on the Shore Durometer Scale A. Polytetrafluoroethylene (PTFE) typically has a rating of approximately 60 on the Shore Durometer Scale D. Various nylons typically have a rating of approximately 80 on the Shore Durometer Scale D. For comparison purposes, hard wheels of roller skates or a skateboard typically rate approximately 100 on the Shore Durometer Scale A. High-density polyethylene typically rates approximately 75 on the Shore Durometer Scale D. A textile's or a material's hardness correlates linearly with that textile's or that material's tensile strength, measured in mega-pascals (MPa), which is used to determine flexibility. Tensile strength is the capacity of a material or structure to withstand loads tending to elongate or resist tension (being pulled apart). Generally, the lower a material's or textile's tensile strength, the more easily that material or textile is deformed or pulled apart via stretching. When too much stress is introduced to any given textile or material, that textile or material suffers from permanent deformation or from fracturing. By way of example, rubber typically has a tensile strength of approximately 16 MPa. Various foams typical in the art have a tensile strength of approximately 52 MPa. Nylon typically has a tensile strength of approximately 75 MPa. Linen typically has a tensile strength of approximately 86 MPa. Leather typically has a tensile strength of approximately between 400 and 500 MPa. Because hardness and tensile strength are linearly related, the harder a textile or material is, the greater its tensile strength is. At tensile strengths greater than approximately 600 MPa, the textile or material is not flexible enough to be shaped around a wearer's foot and will fracture when stress is applied. Conversely, at tensile strengths less than approximately 10 MPa, the textile or material will permanently deform when stress is applied. In the context of this invention, a textile or material with a rating greater than 100 on the Shore Durometer Scale A or a 90 on the Shore Durometer Scale D is considered too hard to be utilized in this invention as the tensile strength will cause the textile or material to fracture when stress is applied. In the context of this invention, a textile or material with a rating less than 10 on the Shore Durometer A Scale is considered not hard enough to be utilized in this invention as the tensile strength will cause the textile or material to permanently deform when stress is applied. When vamp materials (10)(20)(30) include a cross-sectional width (15)(25)(35) greater than 3.0 mm, then the vamp material (10)(20)(30) will exhibit a tensile strength greater than 600 MPa and the vamp material (10)(20)(30) will fracture when stress is applied. Conversely, providing vamp materials (10)(20)(30) with a cross-sectional width (15)(25)(35) less than 1.0 mm will result in a vamp material (10)(20)(30) that has a tensile strength less than 10 MPa and vamp material (10)(20)(30) will permanently deform when stress is applied.

Applicant has advantageously found that forming vamp construction (1) as shown in FIG. 1 with vamp material (10)(20)(30) including a cross-sectional width (15)(25)(35) between 1.8 mm and 2.0 mm offers an ideal ratio of hardness to tensile strength. With a cross-sectional width (15)(25)(35) between 1.8 mm and 2.0 mm, vamp material (10)(20)(30) exhibits the degree of flexibility necessary to stretch comfortably around a wearer's foot without permanently deforming or fracturing due to the stress. Furthermore, with a cross-sectional width (15)(25)(35) between approximately 1.8 mm and 2.0 mm, vamp material (10)(20)(30) exhibits the degree of hardness necessary to provide support for the wearer's foot and also to provide structural support for the article of footwear. In another embodiment, Applicant has advantageously found that that forming vamp construction (1) as shown in FIG. 1 with vamp materials (10)(20)(30) including a cross-sectional width (15)(25)(35) of 1.9 mm offers the best ratio of hardness to tensile strength. With a cross-sectional width (15)(25)(35) of 1.9 mm, vamp material (10)(20)(30) exhibits a degree of flexibility that provides the best comfort to the wearer and exhibits a degree of hardness that provides the most support and protection to the wearer without sacrificing the flexibility necessary to provide comfort. In one embodiment, vamp material (10)(20)(30) includes a cross-sectional width (15)(25)(35) of approximately 1.9 mm. In another embodiment, fabric (10)(20)(30) includes a cross-sectional width (15)(25)(35) that is 1.9 mm.

In another embodiment, the cross-sectional width (15)(25)(35) of the vamp material (10)(20)(30) is between approximately 1.5 and approximately 2.5 mm. Applicant has found that a cross-sectional width (15)(25)(35) between approximately 1.5 and approximately 2.5 mm provides vamp material (10)(20)(30) with a hardness to provide support to a wearer's foot and provide a structure to the article of footwear. In this embodiment, the vamp material (10)(20)(30) retains a tensile strength with flexibility to contour and stretch around a wearer's foot in order to provide comfort without permanently deforming or fracturing when stress is applied. In another embodiment, the cross-sectional width (15)(25)(35) of the vamp material (10)(20)(30) is between approximately 1.0 and approximately 1.5 mm. In this embodiment, vamp material (10)(20)(30) is the least hard and most flexible. In another embodiment, the cross-sectional width (15)(25)(35) of the vamp material (10)(20)(30) is between approximately 2.5 mm and approximately 3.0 mm. In this embodiment, vamp material (10)(20)(30) is the most hard and the least flexible.

In some embodiments as shown in FIGS. 6A-8B and 14A-14D, fabric (100)(200)(300) includes a cross-sectional width (105)(205)(305) of any dimension. In one embodiment, fabric (100)(200)(300) includes a cross-sectional width (105)(205)(305) between approximately 1.0 mm and approximately 2.0 mm. In another embodiment, fabric (100)(200)(300) includes a cross-sectional width (105)(205)(305) between approximately 1.1 mm and approximately 1.8 mm. When fabric (100)(200)(300) includes a cross-sectional width (105)(205)(305) greater than 2.0 mm, fabric (100)(200)(300) will exhibit a tensile strength greater than 600 MPa and the fabric (100)(200)(300) will fracture when stress is applied. Conversely, providing fabric (100)(200)(300) with a cross-sectional width (105)(205)(305) less than 1.0 mm will result in a fabric (100)(200)(300) that has a tensile strength less than 10 MPa and fabric (100)(200)(300) will permanently deform when stress is applied. Additionally, at a cross-sectional width (105)(205)(305) less than 1.0 mm, fabric (100)(200)(300) will lose any unique properties fabric (100)(200)(300) may exhibit, such as being waterproof or breathable.

Applicant has advantageously found that forming vamp construction (1) as shown in FIG. 1 with fabric (100)(200)(300) including a cross-sectional width (105)(205)(305) of approximately 1.4 mm offers an ideal ratio of hardness to tensile strength while retaining the fabric's unique properties. With a cross-sectional width (105)(205)(305) of approximately 1.4 mm, fabric (100)(200)(300) exhibits the degree of flexibility necessary to stretch comfortably around a wearer's foot without permanently deforming or fracturing due to the stress. Furthermore, with a cross-sectional width (105)(205)(305) of approximately 1.4 mm, fabric (100)(200)(300) retains its unique properties. In one embodiment, Applicant has advantageously found that that forming vamp construction (1) as shown in FIG. 1 with fabric (100)(200)(300) including a cross-sectional width (105)(205)(305) of 1.4 mm offers a the best ratio of hardness to tensile strength without losing unique properties of fabric (100)(200)(300). With a cross-sectional width (105)(205)(305) of 1.4 mm, fabric (100)(200)(300) exhibits a degree of flexibility that provides the best comfort to the wearer, will not permanently deform or fracture when stress is applied, and exhibits its unique properties without sacrificing flexibility, hardness, or comfort to the wearer. In one embodiment, fabric (100)(200)(300) includes a cross-sectional width (105)(205)(305) of approximately 1.4 mm. In another embodiment, fabric (100)(200)(300) includes a cross-sectional width (105)(205)(305) that is 1.4 mm.

In another embodiment, the cross-sectional width (105)(205)(305) of the fabric (100)(200)(300) is between approximately 1.1 and approximately 1.8 mm. Applicant has found that a cross-sectional width (105)(205)(305) between approximately 1.1 and approximately 1.8 mm provides fabric (100)(200)(300) with a hardness to provide support to a wearer's foot. In this embodiment, the fabric (100)(200)(300) retains a tensile strength with flexibility to contour and stretch around a wearer's foot in order to provide comfort and fabric (100)(200)(300) also retains its unique properties without permanently deforming or fracturing when stress is applied. In another embodiment, the cross-sectional width (105)(205)(305) of the fabric (100)(200)(300) is between approximately 1.0 and approximately 1.3 mm. In this embodiment, fabric (100)(200)(300) is the least hard and most flexible. In another embodiment, the cross-sectional width (105)(205)(305) of the fabric (100)(200)(300) is between approximately 1.7 mm and approximately 2.0 mm. In this embodiment, fabric (100)(200)(300) is the most hard and the least flexible.

In some embodiments as shown in FIGS. 9A-11B and 14A-14D, elastic material (1000)(2000)(3000) includes a cross-sectional width (1005)(2005)(3005) of any dimension, In one embodiment, elastic material (1000)(2000)(3000) includes a cross-sectional width (1005)(2005)(3005) between approximately 1.0 mm and 2.0 mm. In another embodiment, elastic material (1000)(2000)(3000) includes a cross-sectional width (1005)(2005)(3005) between approximately 1.1 mm and 1.9 mm. When elastic material (1000)(2000)(3000) includes a cross-sectional width (1005)(2005)(3005) greater than 2.0 mm, elastic material (1000)(2000)(3000) will exhibit a tensile strength greater than 600 MPa and the elastic material (1000)(2000)(3000) will fracture when stress is applied. Conversely, providing elastic material (1000)(2000)(3000) with a cross-sectional width (1005)(2005)(3005) less than 1.0 mm will result in an elastic material (1000)(2000)(3000) that has a tensile strength less than 10 MPa and will permanently deform when stress is applied. Additionally, at a cross-sectional width (1005)(2005)(3005) less than 1.0 mm, elastic material (1000)(2000)(3000) will lose any unique properties elastic material (1000)(2000)(3000) may exhibit, such as being waterproof or breathable.

Applicant has advantageously found that forming vamp construction (1) as shown in FIG. 1 with elastic material (1000)(2000)(3000) including a cross-sectional width (1005)(2005)(3005) of approximately 1.5 mm offers an ideal ratio of hardness to tensile strength while retaining the elastic material's unique properties. With a cross-sectional width (1005)(2005)(3005) of approximately 1.5 mm, elastic material (1000)(2000)(3000) exhibits the degree of flexibility necessary to stretch comfortably around a wearer's foot without permanently deforming or fracturing due to the stress. Furthermore, with a cross-sectional width (1005)(2005)(3005) of approximately 1.5 mm, elastic material (1000)(2000)(3000) retains its unique properties. In one embodiment, Applicant has advantageously found that that forming vamp construction (1) as shown in FIG. 1 with elastic material (1000)(2000)(3000) including a cross-sectional width (1005)(2005)(3005) of 1.5 mm offers a the best ratio of hardness to tensile strength without losing unique properties. With a cross-sectional width (1005)(2005)(3005) of 1.5 mm, elastic material (1000)(2000)(3000) exhibits a degree of flexibility that provides the best comfort to the wearer, will not permanently deform or fracture when stress is applied, and exhibits its unique properties without sacrificing flexibility, hardness, or comfort to the wearer. In one embodiment, elastic material (1000)(2000)(3000) includes a cross-sectional width (1005)(2005)(3005) of approximately 1.5 mm. In one embodiment, elastic material (1000)(2000)(3000) includes a cross-sectional width (1005)(2005)(3005) that is 1.5 mm.

In another embodiment, the cross-sectional width (1005)(2005)(3005) of the elastic material (1000)(2000)(3000) is between approximately 1.1 mm and approximately 1.9 mm. Applicant has found that a cross-sectional width (1005)(2005)(3005) between approximately 1.1 and approximately 1.9 mm provides elastic material (1000)(2000)(3000) with a hardness to provide support to a wearer's foot. In this embodiment, the elastic material (1000)(2000)(3000) retains a tensile strength with flexibility to contour and stretch around a wearer's foot in order to provide comfort and elastic material (1000)(2000)(3000) also retains its unique properties without permanently deforming or fracturing when stress is applied. In another embodiment, the cross-sectional width (1005)(2005)(3005) of the elastic material (1000)(2000)(3000) is between approximately 1.0 and approximately 1.3 mm. In this embodiment, elastic material (1000)(2000)(3000) is the least hard and most flexible. In another embodiment, the cross-sectional width (1005)(2005)(3005) of the elastic material (1000)(2000)(3000)) is between approximately 1.7 mm and approximately 2.0 mm. In this embodiment, elastic material (1000)(2000)(3000) is the most hard and the least flexible.

Providing vamp material (10)(20)(30), fabric (100)(200)(300), and elastic material (1000)(2000)(3000) with respective cross-sectional widths (15)(25)(35), (105)(205)(305), and (1005)(2005)(3005) as described herein enables the vamp construction (1) shown in FIG. 1 to include multiple layers as shown in FIGS. 14A-14D. Applicant has unexpectedly found that constructing a vamp (1) with multiple layers including cross-sectional widths (15)(25)(35)(105)(205)(305)(1005)(2005)(3005) as herein described in one embodiment results in a vamp (1) that does not fracture or permanently deform when stress is applied, protects and supports and comforts the wearer's foot, supports the structure of the article of footwear, repels water and other liquids, and keeps the wearer's foot cool and dry, among other objectives.

Figure 2:
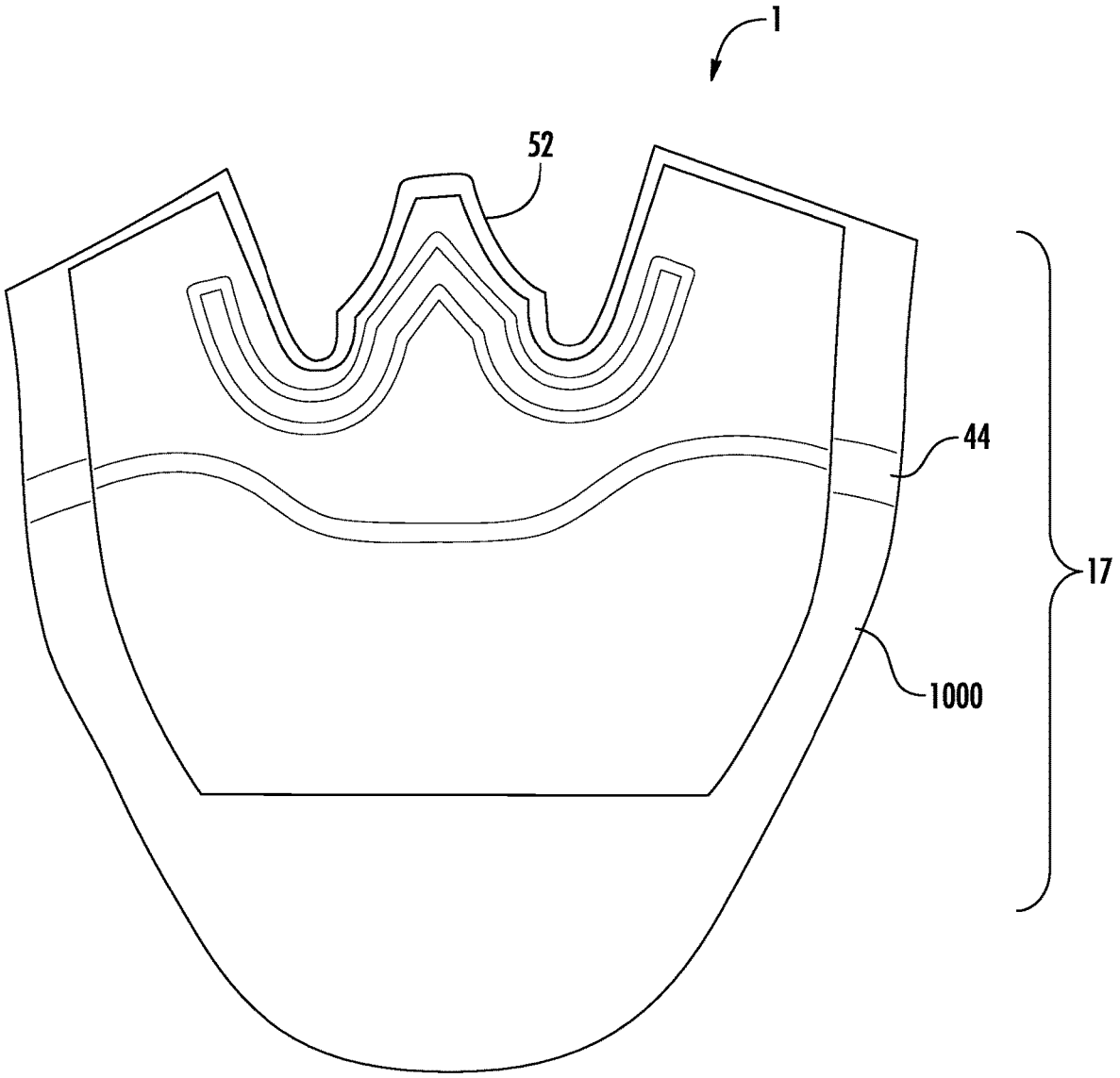
FIG. 2 is a bottom view of the vamp construction depicted in FIG. 1.

FIG. 2 discloses a bottom view of the vamp construction (1) of the present invention. Vamp materials (20)(30) are shown along with elastic material (3000). Fabric (200) is secured between vamp materials (20)(30) and elastic material (3000). With continuing reference to FIG. 1, the vamp construction (1) of the present invention is described in greater detail. In some embodiments, vamp construction (1) includes vamp material (10). In another embodiment, vamp construction (1) includes vamp material (20). In other embodiments, vamp construction (1) includes vamp material (30). In some embodiments, vamp materials (20)(30) are secured together to achieve the vamp construction (1) depicted in FIG. 1. As shown in FIGS. 1-2, vamp construction (1) includes a vamp material (30) which also serves as the forward portion or toe region (36). Vamp construction (1) also includes a vamp material (20) which also serves as the rearward portion or saddle portion (26).

More specifically, in one embodiment, shown in FIG. 15, vamp material (30) is a forward toe portion (36) secured to vamp material (20), which is a rearward saddle portion (26) along a securing portion (44). In some embodiments, securing portion (44) is contoured into a fanciful shape or design. In other embodiments, securing portion (44) is not contoured.

In some embodiments as shown in FIGS. 1 and 15, saddle portion (26) extends from the rearward edge of toe portion (36) at securing portion (44) to tongue (40). In some embodiments, an overlap is formed at securing portion (44) between saddle portion (26) and toe portion (36) as shown in FIG. 1. In other embodiments, saddle portion (26) meets toe portion (36) at their respective edges. In one embodiment, saddle portion (26) includes side extents (41) and a tongue (40). In other embodiments, saddle portion (26) does not include side extents (41) or tongue (40). Prior to it being fitted upon a boot, the vamp construction (1) forms a flat configuration as shown in FIGS. 1 and 2. However, once secured on a boot, toe portion (36) of vamp construction (1) takes a rounded or arched configuration about the foot of the wearer. Additionally, the forward extents (41) of saddle portion (26) likewise form a rounded shape along securing portion (44). The side extents (41), however, are positioned in generally horizontal planes along the sides of a boot. Likewise, tongue (40) is positioned in a vertical plane along a leg portion (63) of a boot. In some embodiments, the edge of tongue (40) is a generally circular shape. In some embodiments, the edge of tongue (40) is a generally oval or oblong shape. In some embodiments, the edge of tongue (40) is a generally rectangular shape.

In one embodiment, shown in FIG. 2, the instep portion (50) of the saddle (26) includes an opening (52). In another embodiment, opening (52) is provided in toe region (36). In another embodiment, opening (52) is provided in tongue (40). In another embodiment, opening (52) is provided in extant (41). In another embodiment, opening (52) is provided on securing portion (44). In other embodiments, opening (52) is not present.

Applicant has advantageously found that providing opening (52) in any of vamp material (10)(20)(30), fabric (100)(200)(300), or elastic material (1000)(2000)(3000) enables the vamp construction (1) to stretch and flex without causing enough stress on the individual textiles to fracture. In some embodiments, cross-sectional width (15)(25)(35) is 3.0 mm; (105)(205)(305) is 2.0 mm; and (1005)(2005)(3005) is 2.0 mm in order to provide maximum protection and hardness to the vamp construction (1). In such an embodiment, the tensile strength is greater than 600 MPa and will fracture when stress is applied. To prevent fracture, opening (52) extends throughout all cross-sectional widths (15)(25)(35); (105)(205)(305); and (1005)(2005)(3005) to reduce the stress placed on the textiles, thereby allowing the resulting vamp construction (1) to flex and stretch around a wearer's foot without fracturing.

In some embodiments including cross-sectional widths (15)(25)(35); (105)(205)(305); and (1005)(2005)(3005) less than 3.0 mm, 2.0 mm, and 2.0 mm respectively, opening (52) extends partially through cross-sectional widths (15)(25)(35); (105)(205)(305); and (1005)(2005)(3005) as less flexibility is required. In some embodiments, opening (52) extends through only a first layer of the vamp construction depicted in FIGS. 14A-14D. In another embodiment, opening (52) extends through a first and second layer of the vamp construction depicted in FIGS. 14A-14D. In yet another embodiment, opening (52) extends through first, second, and third layers of the vamp construction depicted in FIGS. 14A-14D. In yet another embodiment, opening (52) extends through first, second, third, and fourth layers of the vamp construction depicted in FIGS. 14A-14D. In some embodiments, opening (52) is defined by stitching. In other embodiments, opening (52) is defined by any of securing methods (403)-(407), (504)-(506), and (513).

Figure 3A:
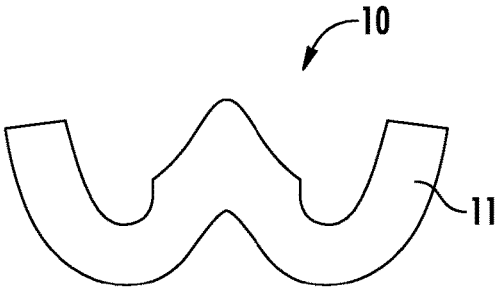
FIG. 3A is a top view of a vamp material depicted in FIG. 1.
Figure 3B:
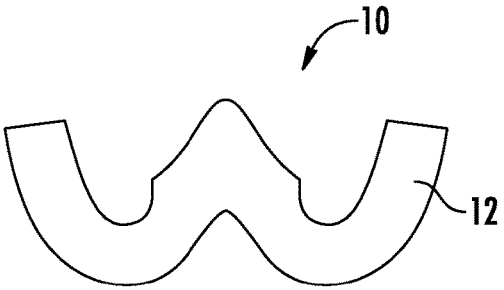
FIG. 3B is a bottom view of another vamp material depicted in FIG. 1.

FIGS. 3A-3B disclose vamp material (10), which further includes top portion (11) and bottom portion (12).

Figure 4A:
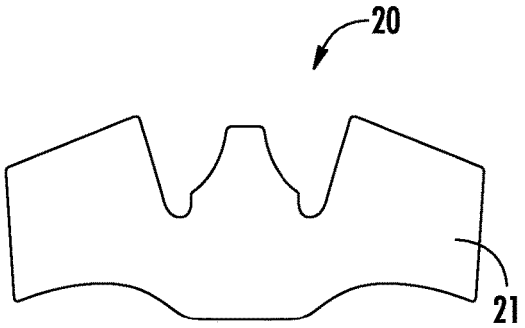
FIG. 4A is a top view of another vamp material depicted in FIG. 1.
Figure 4B:
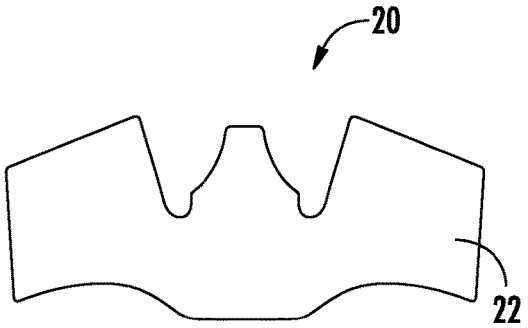
FIG. 4B is a bottom view of another vamp material depicted in FIG. 1.

FIGS. 4A-4B disclose vamp material (20), which further includes top portion (21) and bottom portion (22).

Figure 5A:
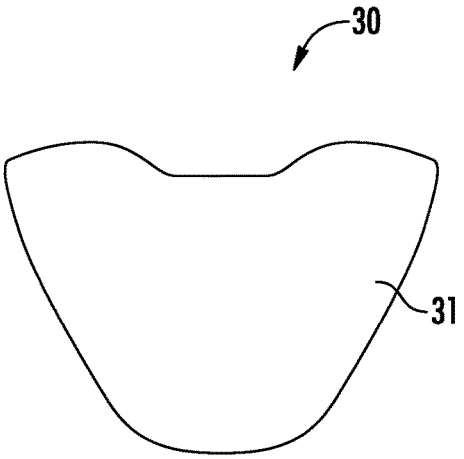
FIG. 5A is a top view of another vamp material depicted in FIG. 1.
Figure 5B:
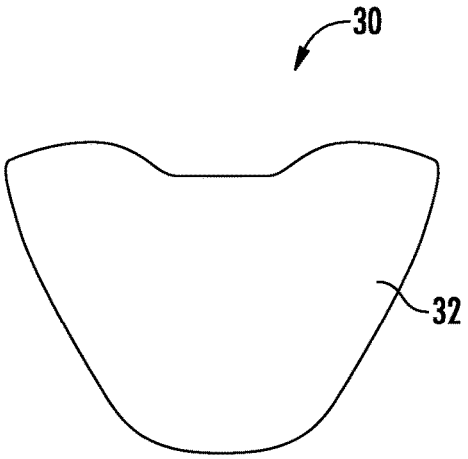
FIG. 5B is a bottom view of another vamp material depicted in FIG. 1.

FIGS. 5A-5B disclose vamp material (30), which further includes top portion (31) and bottom portion (32).

Figure 6A:
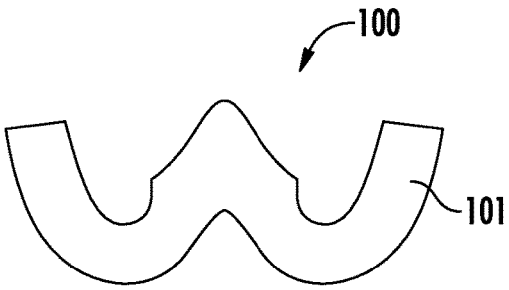
FIG. 6A is a top view of a fabric depicted in FIG. 1.
Figure 6B:
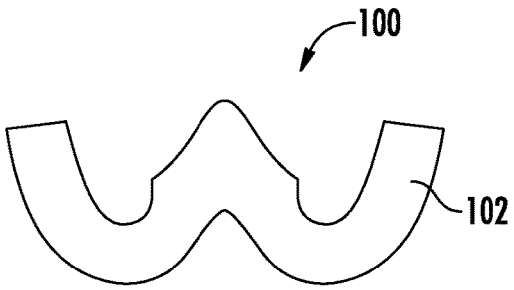
FIG. 6B is a bottom view of another fabric depicted in FIG. 1.

FIGS. 6A-6B disclose fabric (100), which further includes top portion (101) and bottom portion (102).

Figure 7A:
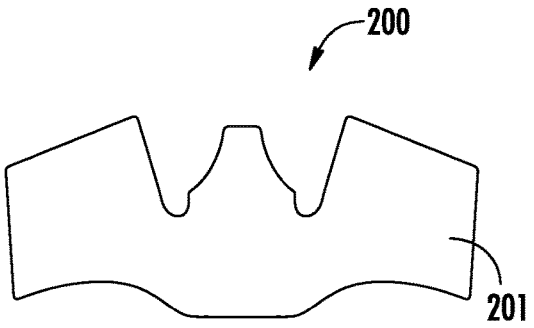
FIG. 7A is a top view of another fabric depicted in FIG. 1.
Figure 7B:
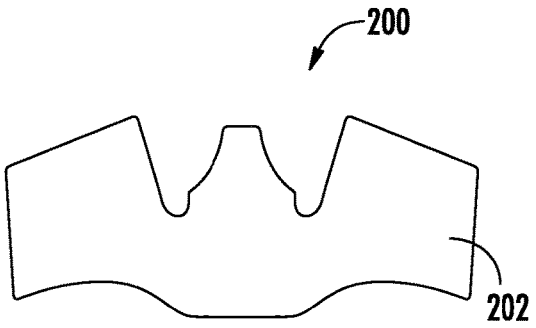
FIG. 7B is a bottom view of another fabric depicted in FIG. 1.

FIGS. 7A-7B disclose fabric (200), which further includes top portion (201) and bottom portion (202).

Figure 8A:
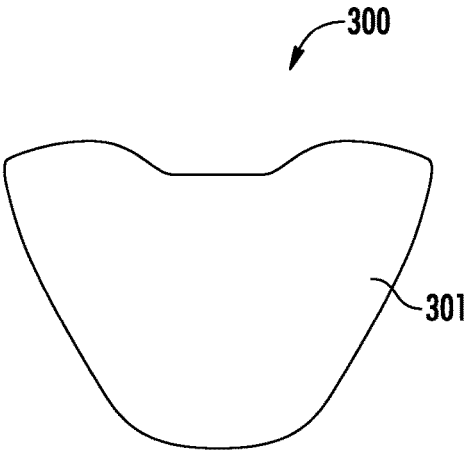
FIG. 8A is a top view of another fabric depicted in FIG. 1.
Figure 8B:
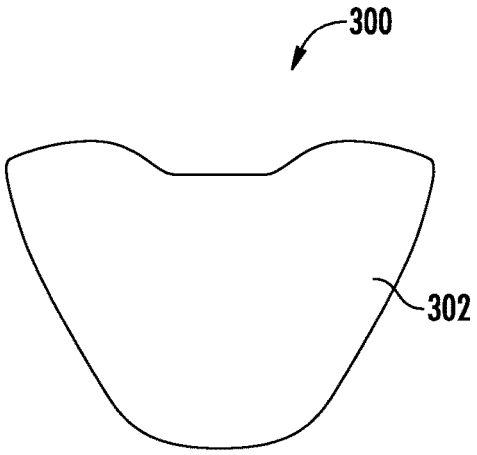
FIG. 8B is a bottom view of another fabric depicted in FIG. 1.

FIGS. 8A-8B disclose fabric (300), which further includes top portion (301) and bottom portion (302).

Figure 9A:
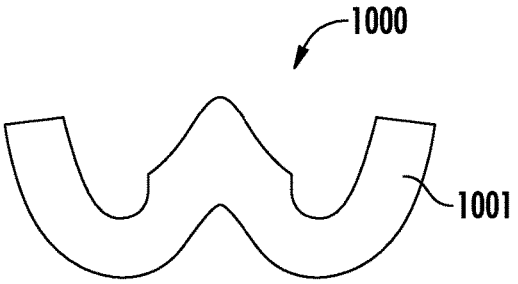
FIG. 9A is a top view of a elastic material depicted in FIG. 1.
Figure 9B:
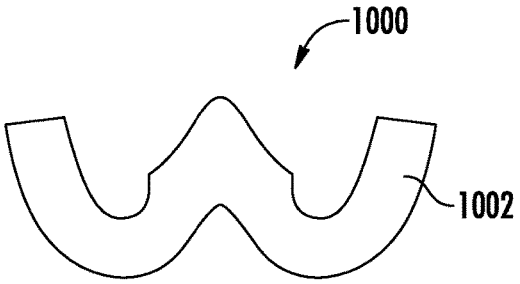
FIG. 9B is a bottom view of another elastic material depicted in FIG. 1.

FIGS. 9A-9B disclose elastic material (1000), which further includes top portion (1001) and bottom portion (1002).

Figure 10A:
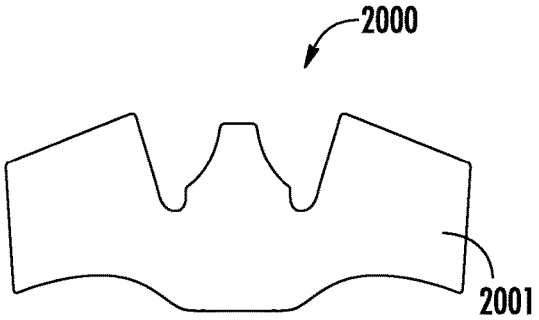
FIG. 10A is a top view of another elastic material depicted in FIG. 1.
Figure 10B:
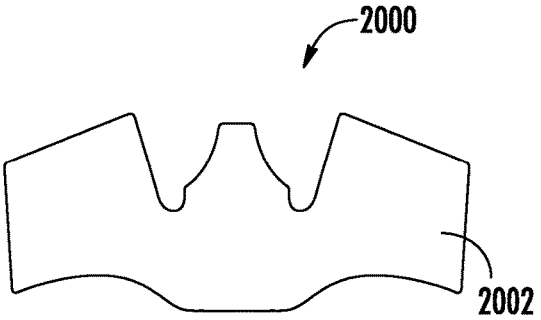
FIG. 10B is a bottom view of another elastic material depicted in FIG. 1.

FIGS. 10A-10B disclose elastic material (2000), which further includes top portion (2001) and bottom portion (2002).

Figure 11A:
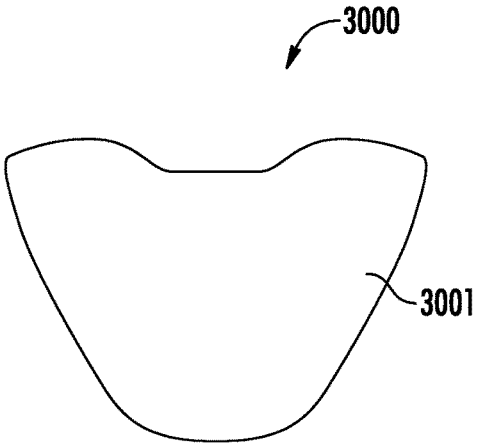
FIG. 11A is a top view of another elastic material depicted in FIG. 1.
Figure 11B:
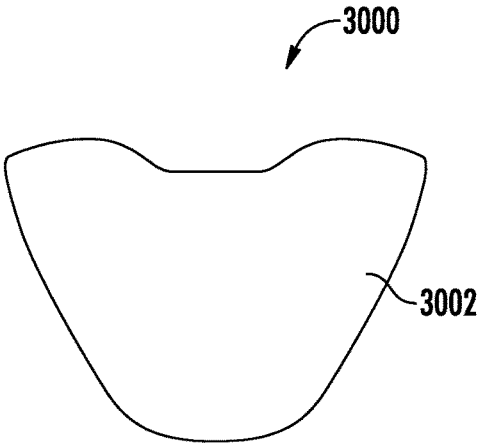
FIG. 11B is a bottom view of another elastic material depicted in FIG. 1.

FIGS. 11A-11B disclose elastic material (3000), which further includes top portion (3001) and bottom portion (3002).

Figure 12:
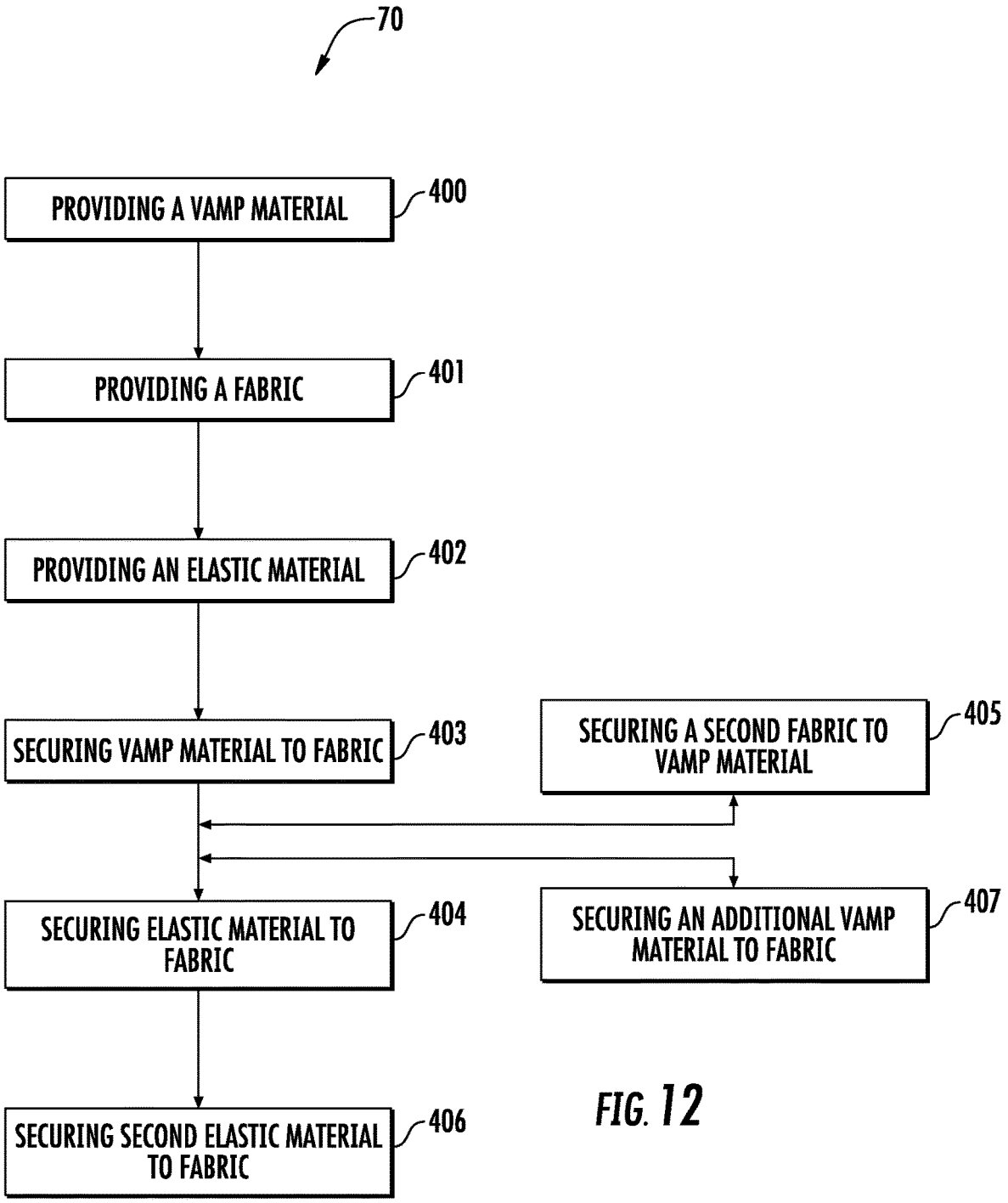
FIG. 12 depicts a method for constructing the vamp depicted in FIG. 1.

FIG. 12 discloses one method (70) of manufacturing vamp construction (1). FIG. 12 depicts a step (400) of providing vamp material, a step (401) of providing a fabric, and a step (402) of providing an elastic material. After steps (400)-(402) of providing the textiles are completed, the vamp material is secured to the fabric (403). The vamp material and fabric textiles are then secured to the elastic material (404). The securing steps (403)(404) are achieved by bonding, laminating, sealing, stitching, tacking, any combination thereof in other embodiments, or by any variety of securing textiles to one another.

FIG. 14A depicts a cross-sectional view (65) of the vamp construction (1) shown in FIG. 16. Depicted are vamp material (20) and cross-sectional width (25), fabric (200) and cross-sectional width (205), and elastic material (2000) and cross-sectional width (2005).

With reference to FIG. 12, another embodiment of the present invention further includes a step of providing and securing (405) at least a second fabric (100) to the vamp material. This second fabric is meant to provide additional water-proofing and breathability to the vamp construction. In another embodiment, a further step of providing and securing (406) at least a second elastic material (200) to the fabric. This second elastic material is meant to provide additional flexibility to the vamp construction (1) and comfort to the wearer. In yet another embodiment, a further step of providing and securing (407) at least an additional vamp material (10) to the fabric is included. The securing steps (403)-(407) are achieved by steps of bonding, laminating, sealing, stitching, tacking, any combination thereof in other embodiments, or by any variety of securing textiles.

Figure 13:
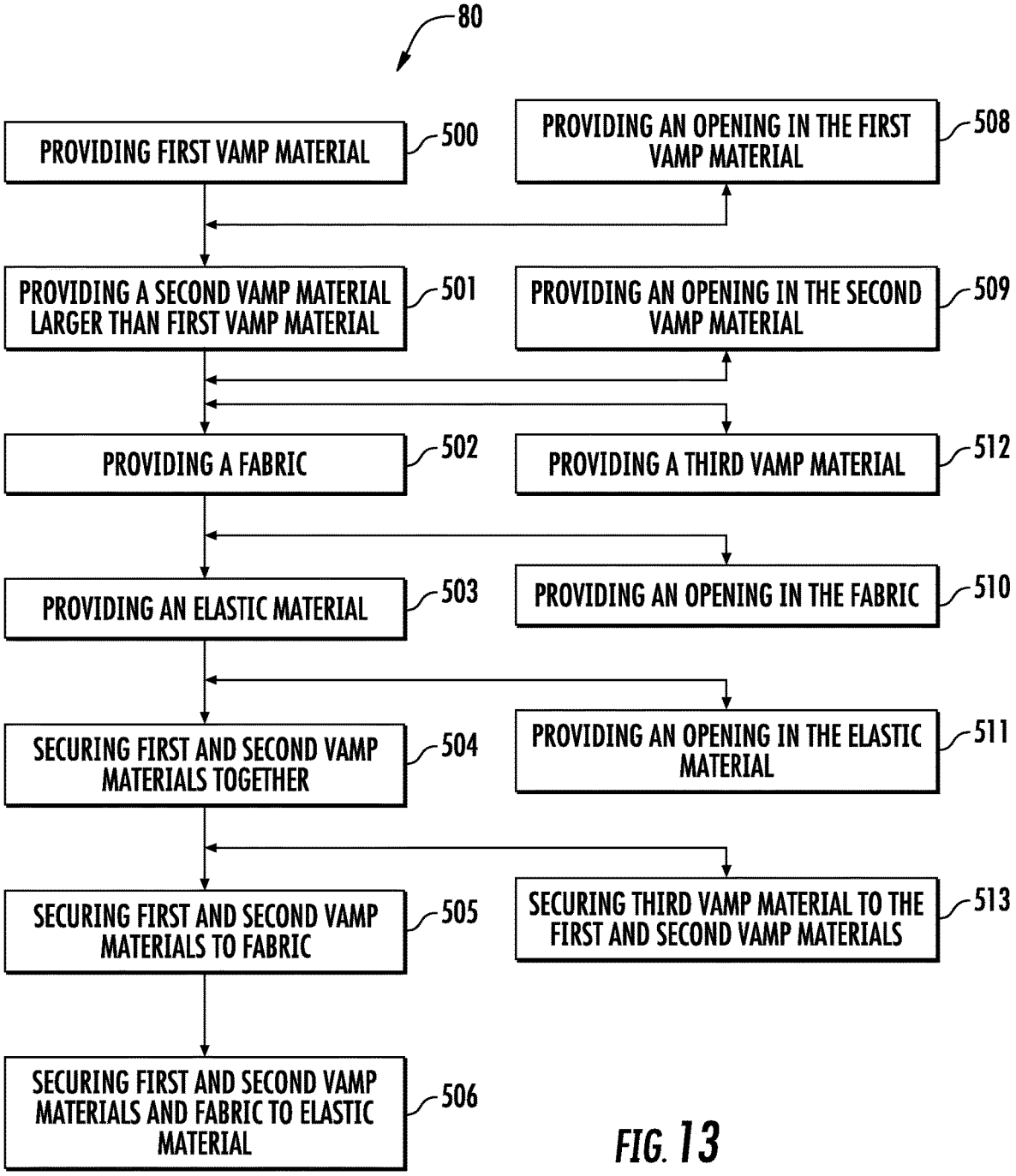
FIG. 13 depicts another method for constructing the vamp depicted in FIG. 1.

FIG. 13 depicts another method (80) of manufacturing a vamp construction (1) further comprising multiple layers. FIG. 13 depicts a step of providing a first vamp material (500), a step of providing a second vamp material larger than the first vamp material (501), providing a fabric (502), and providing an elastic material (504). The vamp materials are then secured to each other (504). The secured vamp materials are then further secured to the fabric (505). This portion is then further secured to an elastic material (506) to form a multi-layer vamp construction. The securing steps (504)-(506) are achieved by bonding, laminating, sealing, stitching, tacking, any combination thereof as herein described in another embodiments, or by any variety of securing textiles.

FIG. 14B depicts a cross-sectional view (75) of the vamp construction (1) shown in FIG. 16. Depicted are vamp material (20) and cross-sectional width (25), vamp material (30) and cross-sectional width (35), fabric (200) and cross-sectional width (205), and elastic material (2000) and cross-sectional width (2005).

In one embodiment as shown in FIGS. 1 and 15, the vamp materials (10)(20)(30) are secured on a securing portion (44) provided on each of the vamp materials. In yet another embodiment, steps (508)-(511) of providing an opening (52) in any of the vamp materials (10)(20)(30), fabrics (100)(200)(300), elastic materials (1000)(2000)(3000), or any combination thereof as described in any of the embodiments, is included.

In another embodiment, a step of providing (512) and securing (513) a third vamp material (10). This third vamp material (10) is smaller than the first vamp material (20) and is meant to provide extra protection to the wearer's leg when engaged in horse-back riding.

In another embodiment of this invention, an article of footwear (60) comprising a vamp (64) is provided, as depicted in FIG. 15. In one embodiment, the article of footwear (60) includes upper and bottom portions (61 and 62, respectively) that are secured to one another. The upper portion (61) comprises a leg portion (63), a vamp portion (64), and rear foxing (69). The bottom portion (62) comprises an insole (66) (or midsole), an outsole (67), and a heel (68). The present invention relates to the construction and design of the vamp (64). The vamp (64) comprises at least a layer of vamp material (20), at least a first layer of fabric (200), and at least a first layer of elastic material (2000), wherein the layer of fabric (200) is secured between the layer of vamp material (20) and the first layer of elastic material (2000). In another embodiment, the vamp (64) further includes a second layer of fabric (300) secured between the layer of vamp material (20) and the layer of elastic material (2000). In yet another embodiment, the layer of vamp material (20) is secured between the first layer of fabric (200) and the first layer of elastic material (2000), as depicted in the cross-sectional view (85) of FIG. 14C.

FIG. 14C depicts cross sectional view (85) of the vamp construction (1) shown in FIG. 16. Depicted are fabric (200) and cross-sectional width (205), vamp material (20) and cross-sectional width (25), and elastic material (2000) and cross-width (2005).

According to the embodiment depicted in cross-sectional view (85), the layer of fabric (200) forms the outer-most layer of the vamp (64). Due to the way these textiles stretch, shape, and curve over the wearer's foot, the outer-most layer of the vamp will undergo the most amount of stretching. By securing the fabric (200) as the outer-most layer, the vamp material (20) will undergo less stress and will be less likely to deform or fracture or cause the wearer discomfort.

In another embodiment of this invention, vamp material (20) includes a top portion (21) and a bottom portion (22). Top portion (21) forms the outer-most portion of the vamp construction (1) and is visible to the wearer. Bottom portion (22) is secured to a top portion (201) of fabric (200). A bottom portion (202) of fabric (200) is then secured to a top portion (2001) of elastic material (2000). Bottom portion (2002) of elastic material (2000) forms the inner-most portion of the vamp construction (1) and contacts the wearer's foot.

In yet another embodiment, at least a second layer of fabric (300) and at least a second layer of elastic material (3000) are secured to the layer of vamp material (20) in an alternating series, as depicted in the cross-sectional view (95) of FIG. 14D. Depicted in cross-sectional view (95) are vamp material (20) and cross-sectional width (25), fabric (200) and cross-sectional width (205), elastic material (2000) and cross-sectional width (2005), fabric (300) and cross-sectional width (305), and elastic material (3000) and cross-sectional width (3005).

FIG. 1 discloses a top view of the vamp construction (1) of the present invention. In one embodiment as shown in FIGS. 3A-5B, vamp materials (10)(20)(30) are made of leather. In another embodiment as shown in FIGS. 3A-5B, vamp materials (10)(20)(30) are rubber. In yet another embodiment as shown in FIGS. 3A-5B, vamp materials (10)(20)(30) are plastic. In yet another embodiment as shown in FIGS. 3A-5B, vamp materials (10)(20)(30) are cloth. In yet another embodiment as shown in FIGS. 3A-5B, vamp materials (10)(20)(30) are cotton. In yet another embodiment as shown in FIGS. 3A-5B, vamp materials (10)(20)(30) are wool. In yet another embodiment as shown in FIGS. 3A-5B, vamp materials (10)(20)(30) are flax. In yet another embodiment as shown in FIGS. 3A-5B, vamp materials (10)(20)(30) are made of any textile or material not already herein described.

As shown in FIGS. 6A-8B and 14A-14D, fabric (100)(200)(300) is made of any variety of fabrics known. In some embodiments as shown in FIGS. 6A-8B, fabric (100)(200)(300) is breathable. In yet other embodiments as shown in FIGS. 6A-8B, fabric (100)(200)(300) is waterproof. In yet other embodiments as shown in FIGS. 6A-8B, fabric (100)(200)(300) is soft. In yet other embodiments as shown in FIGS. 6A-8B, fabric (100)(200)(300) is flexible.

In the context of the invention, the term waterproof refers to a material which is waterproof or water-resistant, meaning a material acts as a barrier to water or other liquid penetration. The term breathable-waterproof, in this context, means that a material allows water vapor to escape through the upper, i.e., from the foot out (perspiration), while being impervious to water coming in from the outside.

In some embodiments shown in FIGS. 1, 6A-8B, and 14A-14D, fabric (100)(200)(300) is a polymeric membrane material. Suitable polymeric membrane material include polyurethane, polyester, polyether, polyamide, polyacrylate, copolyether ester, and copolyether amide. Further, the polymeric membrane material shown in FIGS. 6A-8B could be microporous, expanded polytetrafluoroethylene. In other embodiments as shown in FIGS. 6A-8B, fabric (100)(200)(300) is polytetrafluoroethylene. In one embodiment as shown in FIGS. 6A-8B, fabric (100)(200)(300) is microporous. In another embodiment as shown in FIGS. 6A-8B, fabric (100)(200)(300) is expanded polytetrafluoroethylene membrane.

As shown in FIGS. 9A-11B and 14A-14D, elastic material (1000)(2000)(3000) is made of any variety of elastic materials known. In another embodiment as shown in FIGS. 9A-11B, elastic material (1000)(2000)(3000) is rubber. In some embodiments as shown in FIGS. 9A-11B, elastic material (1000)(2000)(3000) is a foam. In some embodiments as shown in FIGS. 9A-11B, elastic material (1000)(2000)(3000) is waterproof. In yet another embodiment as shown in FIGS. 9A-11B, elastic material (1000)(2000)(3000) is vinyl. In yet another embodiment as shown in FIGS. 9A-11B, elastic material (1000)(2000)(3000) is ethylene-vinyl acetate (EVA). In yet another embodiment as shown in FIGS. 9A-11B, elastic material (1000)(2000)(3000) is polyethylene-vinyl acetate (PEVA).

Because the vamp construction (1) comprises textiles including the cross-sectional widths herein described, multiple layers are provided without making the vamp too bulky or rigid. The additional layers thus provide additional waterproofing, breathability, flexibility, or any combination thereof to the vamp without sacrificing comfort to the wearer. However, it should be noted that the present invention is not limited to a specific amount of layers or a specific order thereof. The amount of layers and the composition of the layers are determined by one of ordinary skill in the art in order to meet multiple purposes.

The present disclosure includes that contained in the appended claims, as well as that of the foregoing description. Although this invention has been described in its form with a certain degree of particularity, it is understood that the present disclosure of the forms have been made only by way of example and that numerous changes in the details of construction and the combination and arrangement of parts may be resorted to without departing from the spirit and scope of the invention.

I claim:

1. A method of constructing a vamp for footwear, comprising the steps of:

providing a first vamp material with a top face and a bottom face, layer I;

providing an opening in said first vamp material;

providing a second vamp material larger than said first vamp material and which comprises a top face and a bottom face, layer II;

providing a third vamp material smaller than said first vamp material and which comprises a top face and a bottom face, layer III;

providing a fabric which is smaller than said first vamp material portion and which comprises a top face and a bottom face, layer IV;

laminating said top face of said layer IV to said bottom face of said layer I;

placing a portion of said top face of said layer II under said bottom face of said layer I to form an overlaid portion and an overlaid vamp material;

securing said top face of layer Ill to said bottom face of layer II;

providing an elastic material which is smaller than said overlaid vamp material;

placing said elastic material on said bottom face of said layer IV and said bottom face of said layer II such that said elastic material covers said overlaid portion;

stitching together said elastic material and said layer I, layer II, and layer III;

providing a tongue;

providing a securing portion;

forming an overlap between a saddle portion and a toe portion at said securing portion;

wherein said saddle portion extends from a back end of said toe portion until a front end of a heel region.

2. The method of constructing a vamp for footwear according to claim 1, further comprising the steps of:

providing a second fabric, layer V, that is approximately the same size of said layer I and;

providing a third fabric, layer VI, that is approximately the same size of said layer II.

3. The method of constructing a vamp for footwear according to claim 2, further comprising a step of placing said layer V on top of said layer I;

placing said layer VI on top of said layer II;

Such that the order of layers from top to bottom is V, I, IV VI, II, and III.

4. The method of constructing a vamp for footwear according to claim 3, wherein said second and third fabrics are stitched together with said elastic material, said layer IV, and said layer I and said layer II.

5. The method of constructing a vamp for footwear according to claim 2, further comprising a step of laminating together said layer V on said top of said layer I and laminating together said layer VI on said top of said layer II before a portion of said layer II is placed under said layer I.

6. The method of constructing a vamp for footwear according to claim 1, further comprising the step of stitching together said layer I, said layer IV, and said layer V.

7. The method of constructing a vamp for footwear, comprising the steps of:

providing a first vamp material;

providing an opening in said first vamp material;

providing a second vamp material larger than said first vamp material;

providing an opening in said second vamp material;

providing a third vamp material;

wherein said third vamp material is smaller than said first vamp material;

providing a fabric;

providing an elastic material;

stitching said first vamp material and said second vamp materials together;

stitching said third vamp material to said first vamp material and said second vamp material;

bonding said first vamp material and said second vamp material to said fabric;

laminating said first vamp material and said second vamp material to said elastic material;

providing a tongue.

8. The method for constructing a vamp for footwear according to claim 7, further comprising the step of providing an opening in said fabric.

9. The method for constructing a vamp for footwear according to claim 7, further comprising the step of providing an opening in said elastic material.

* * * * *